US009364382B1

(12) United States Patent
Cooper et al.

(10) Patent No.: US 9,364,382 B1
(45) Date of Patent: Jun. 14, 2016

(54) MULTI-PLANAR DEVICE FOR STRETCHING PORTIONS OF A FOOT AND LOWER LEG

(71) Applicant: Phoenix Foot Health, LLC, Charlotte, NC (US)

(72) Inventors: James Harold Cooper, Charlotte, NC (US); Stephen Gilbert Sims, Chapel Hill, NC (US); William Cameron Bell, Mooresville, NC (US)

(73) Assignee: Phoenix Foot Health, LLC, Charlotte, NC (US)

( * ) Notice: Subject to any disclaimer, the term of this patent is extended or adjusted under 35 U.S.C. 154(b) by 0 days.

(21) Appl. No.: 14/504,679

(22) Filed: Oct. 2, 2014

Related U.S. Application Data

(60) Provisional application No. 61/886,844, filed on Oct. 4, 2013.

(51) Int. Cl.
*A63B 23/08* (2006.01)
*A61H 1/02* (2006.01)

(52) U.S. Cl.
CPC ..... *A61H 1/0237* (2013.01); *A61H 1/0266* (2013.01)

(58) Field of Classification Search
CPC ..... A63B 2023/006
See application file for complete search history.

(56) References Cited

U.S. PATENT DOCUMENTS 3,746,335 A * 7/1973 Fichter ..... A63K 3/023 482/19
5,087,036 A * 2/1992 Cooper ..... A63B 23/085 482/79
5,980,433 A * 11/1999 Ramsay ..... A63B 23/085 482/80

* cited by examiner

*Primary Examiner* — Loan H Thanh
*Assistant Examiner* — Rae Fischer
(74) *Attorney, Agent, or Firm* — Coats & Bennett, P.L.L.C.

(57) ABSTRACT

A stretching device and method of use for stretching the foot and lower leg muscles of a user. The stretching device may include a base and an adjustable incline support that can be adjusted at various angles relative to the base. The incline support may further be divided into separate fingers that can be adjusted to different angular positions relative to one another. A support member may extend across and support the incline support.

15 Claims, 10 Drawing Sheets

MULTI-PLANAR DEVICE FOR STRETCHING PORTIONS OF A FOOT AND LOWER LEG

REFERENCE TO RELATED APPLICATIONS

This application claims the benefit of U.S. Application 61/886,844 filed on Oct. 4, 2013 and entitled Multi-Planar Device for Stretching Portions of a Foot and Leg which is hereby incorporated by reference in its entirety.

BACKGROUND

Various foot, ankle, and leg injuries occur that result in pain and discomfort, and limit the mobility of the injured person. One type of injury is plantar fasciitis which is a medical condition characterized by inflammation of the plantar fascia (i.e., thick tissue on the bottom of the foot) that causes heel pain and disability. More specifically, the plantar fascia is a thick band of tissue that covers the bones on the bottom of the foot and extends from the base of the heel bone to each of the toes of the foot. Plantar fasciitis results when lack of ankle joint mobility or lack of arch support causes the flattening of the arch or the spreading of the toes such that sufficient pressure is exerted on the bottom of the foot to cause tears or microtears of the plantar fascia.

A person may also experience excessive pronation of the foot that causes flattening of the medial longitudinal arch. This may also cause increased strain on the plantar fascia and plantar musculature. These issues may be increased when the foot remains pronated, such as during lifting of the heel and toe. Further, during excessive pronation the gastrocnemius-soleus complex and tibialis posterior may contract to slow rotation of the leg and foot pronation. This may contribute to tendinopathy of the Achilles and tibialis posterior tendons.

These various injuries may occur suddenly, or may occur gradually over a period of time. Various devices have been developed to treat these injuries.

Various treatment protocols have been developed to treat these injuries. Plantar fasciitis is often treated by wearing an orthotic designed to heal the condition while permitting the user to remain relatively mobile. The treatment may also include a prescribed stretching program of the lower leg and foot muscles. Another treatment for plantar fasciitis includes the use of supports designed for use when the patient is resting (i.e., when little or no weight is applied to the injured foot). Other plantar fasciitis supports are sized to fit in the person's shoes and worn by the patient during limited activity (e.g., walking to and from bed) as well as when at rest.

Known treatment devices provide for limited stretching, inadequate adjustment or, when provided, the manner of adjustment requires various bulky mechanical devices.

SUMMARY

The present application is directed to devices and methods for stretching the foot and lower leg of a user. The devices and methods provide for stretching in one or more planes through a plurality of adjustable fingers that are connected to a base. The fingers are adjustable relative to a base about a first axis to a variety of different angular orientations in a first plane. The fingers are also able to be adjusted at different angular positions relative to one another to provide for additional stretching of the foot in one or more additional planes.

One embodiment is directed to a device for stretching portions of a foot and lower leg. The device includes a base having a rear section with a back end and a front section with a front end. Fingers are hingedly connected in an overlapping arrangement with the base. Each of the fingers includes an elongated shape with a length measured between a pivot end and a free end. The fingers include first and second fingers that are spaced apart across a width of the base and at least one intermediate finger positioned between the first and second fingers. The device also includes a support member with an elongated shape and opposing first and second ends. The support member extends transversely across the fingers with the first end at the first finger and the second end at the second finger and connecting together the first and second fingers. The support member is positioned along the fingers away from the pivot ends. The fingers are pivotally connected to the base and movable between a common angular orientation in which each of the fingers is at a common angle relative to the base, and an offset angular orientation in which the first finger is at a first angle relative to the base and each of the one or more intermediate fingers and the second finger are at progressively different angles relative to the base with the fingers positioned in an inclined configuration across the width of the base. The support member extends across and supports at least one intermediate finger in each of the common angular orientation and the offset angular orientation.

The support member may include a rigid shaft with opposing first and second ends with the first end positioned at the first finger and the second end positioned at the second finger.

Each of the fingers may be pivotally connected to the base about a common axis. The common axis may be formed by a shaft that extends through the pivot end of each of the fingers.

The support member may extend through an opening formed within each of at least one intermediate finger.

The fingers may be aligned in a row and the first finger may be an outer lateral finger on a first lateral side of the row and the second finger may be another outer finger on a second lateral side of the row.

The device may include a first support arm that extends from an underside of the first finger and a second support arm that extends from an underside of the second finger with each of the support arms including an exposed end that engages with the base to support the fingers.

The device may include first and second rows of indents formed in the base with each of the rows including indents that are spaced apart and extend away from a front end of the base with each of the indents sized to receive the exposed end of one of the first and second support arms.

The fingers may extend across an entirety of the width of the base.

The front section of the base may be recessed below the back section of the base such that the top side of the fingers aligns with the back section when the device is in an open orientation.

Another embodiment is directed to a device for stretching portions of a foot and lower leg. The device includes a base having a first section and a second section. An incline support is positioned at the first section of the base and is pivotally connected to the base at a pivot axis. The incline support is movable about the pivot axis within a range of angular positions between a first angular position and a larger second angular position. The incline support is configured to be supported at the various angular positions relative to the base. A support member is connected to the incline support and includes an elongated shape with opposing first and second ends. The support member extends across the incline support and is spaced away from the pivot axis. The incline support is divided into separate fingers that each includes a first end connected to the base at the pivot axis and a free second end. Each of the fingers is positionable relative to the base at different angles ranging from the first and second angular positions with a difference in the angles between adjacent ones of the fingers being limited by the support member.

The device may also include first and second support arms that are pivotally connected to one of the base and the incline support. The first and second support arms may include an exposed end configured to engage with the other of the base and the incline support to support the incline support relative to the base.

The incline support may extend across an entirety of the width of the front section.

Each of the fingers may include an opening and the support member may be positioned in the opening.

The first section of the base may be recessed below the second section of the base and the incline support may be positioned in an overlapping orientation with the first section of the base such that a top side of the incline support aligns with the second section in an open orientation.

Another embodiment is directed to a method of stretching portions of a foot and lower leg of a user. The method includes: pivoting a first finger that is pivotally connected to a base; supporting the first finger at a first angular position relative to the base; pivoting a second finger that is pivotally connected to the base with the first finger being spaced apart from the second finger across a width of the base; supporting the second finger at a second angular position relative to the base with the second angular position being different than the first angular position; while pivoting the first and second fingers, pivoting intermediate fingers that are connected to the first and second fingers and that are each pivotally connected to the base and that are each positioned between the first and second fingers; positioning each of the intermediate fingers relative to the base at a different angular position that is between the first and second angular positions and forming an inclined platform across the width of the base with the fingers.

The method may also include pivoting the first, second, and intermediate fingers relative to the base about a common pivot axis.

The method may include pivoting the second finger to the first angular position relative to the base and pivoting each of the intermediate fingers to the first angular position with each of the fingers being positioned at the first angular position relative to the base.

The method may include positioning a first support arm between the first finger and the base and supporting the first finger at the first angular position and positioning a second support arm between the second finger and the base and supporting the second finger at the second angular position.

The method may include contacting each of the fingers against a support member that extends across the fingers and supporting each of the fingers at their respective angular positions relative to the base.

Another embodiment is directed to a device for stretching portions of a foot and lower leg. The device includes a base having a rear portion and a front portion. Fingers are moveably secured to the front portion of the base by a base shaft that extends transversely through the base and each base portion of the fingers. A mid-portion shaft moveably connects together the fingers and extends transversely through mid-portions of each of the fingers. The mid-portion shaft is retained by elongate openings in each of the fingers that provide movement for at least one finger relative to at least one adjacent finger. At least one incline support includes an enlarged shape with opposing first and second ends. The device also includes openings formed along edges of the front portion of the base to receive ends of the one or more incline supports. The fingers and the one or more incline supports provide a variety of secure positions for the fingers to support portions of the user's foot. The fingers can be positioned at a variety of positions ranging from a planar position with respect to the mid-portion of the base to various inclined positions among individual fingers with respect to edges of the base.

The device may also include a textured surface for retaining a foot during use with the textured surface extending transversely across the mid-portion of the base.

The device may also include a textured surface for retaining a foot during use with the textured surface extending along one or more sections of the device, such as one or more fingers, or one or more portions of the rear base. The textured surface may be formed within the elements themselves, or may be a separate member that is attached to the device, such as textured tape.

The device may include at least one retaining device for removably securing one or more incline supports coplanar with respect to at least one of the outermost fingers. Retaining devices may be secured under a free end of one or more of the outermost fingers and positioned in at least one channel defined in the outermost fingers.

The device may also include at least one support for securing the device to a surface. One or more supports may be secured to a bottom portion of the device.

The openings in the base may be angled with respect to the planar surface of the front portion of the device.

The rear portion of the base may be inclined.

The stretching devices and methods provide for stretching portions of a foot and lower leg having adjustable fingers which provide a multi-planar surface. The device typically includes a base having rear portion, a middle portion, and a front portion for receiving a plurality of fingers, a base shaft for moveably securing the fingers to the base, a mid-portion shaft moveably connecting the fingers to one another, at least one adjustable incline support for supporting at least one finger, and a plurality of openings formed along edges of the front portion of the base for receiving ends of the incline supports.

As configured the plurality of fingers and adjustable incline supports provide a variety of secure positions for the fingers to support portions of a foot, wherein the variety of positions range from a planar position with respect to the mid-portion of the base to a plurality of inclined positions among individual fingers with respect to edges of the base.

The devices and methods provide improved stretching of the lower leg and calf complex comprised of the gastrocnemius and the soleus, and Achilles tendon and arch of the foot. Moreover, the devices and methods may be used with or without shoes worn by the user.

In addition, the devices and methods may place the foot in a correct biomechanical position (e.g., the Windlass Mechanism).

The devices and methods also promote stretching in one or more planes.

The various aspects of the various embodiments may be used alone or in any combination, as is desired.

DETAILED DESCRIPTION

The present application is directed to a device and method for stretching the foot and lower leg muscles of a user. The device includes a base and an adjustable incline support that can be adjusted at various angles relative to the base. The incline support is further divided into separate fingers that can be adjusted relative to one another. Therefore, the device provides for stretching the user's foot within multiple planes. Further, the extent of adjustment in the planes may be adjusted to the needs of the user.

Figure 1:
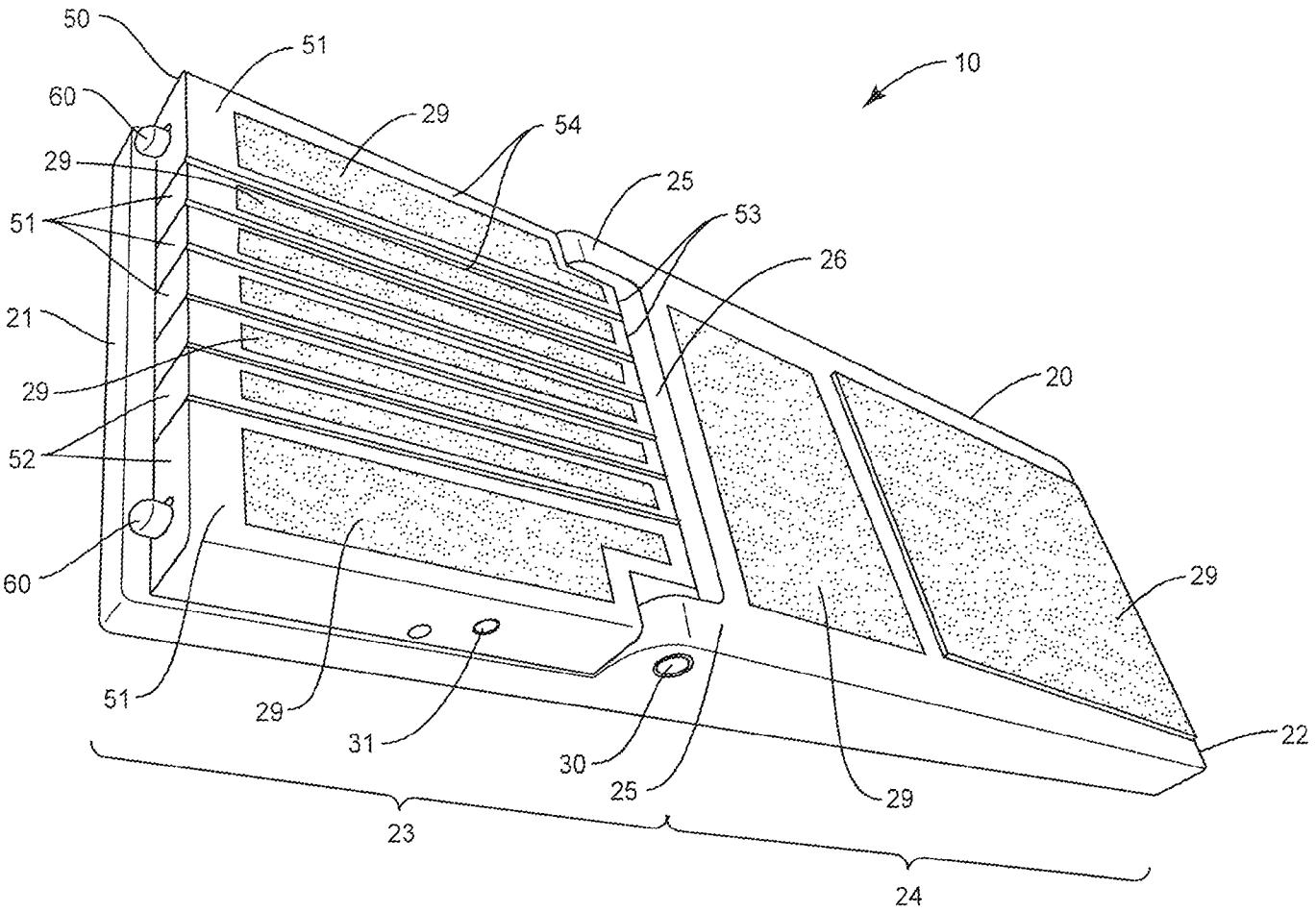
FIG. 1 is a perspective view of a device with fingers in a first orientation.
Figure 2:
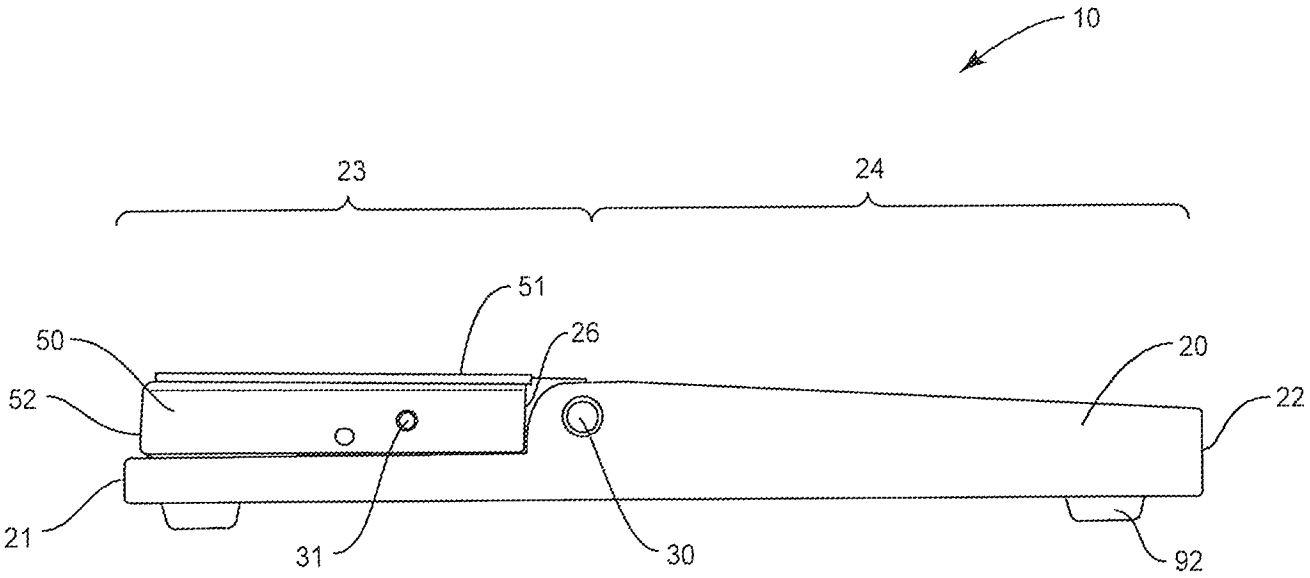
FIG. 2 is a side view of a device with fingers in a first orientation.
Figure 3:
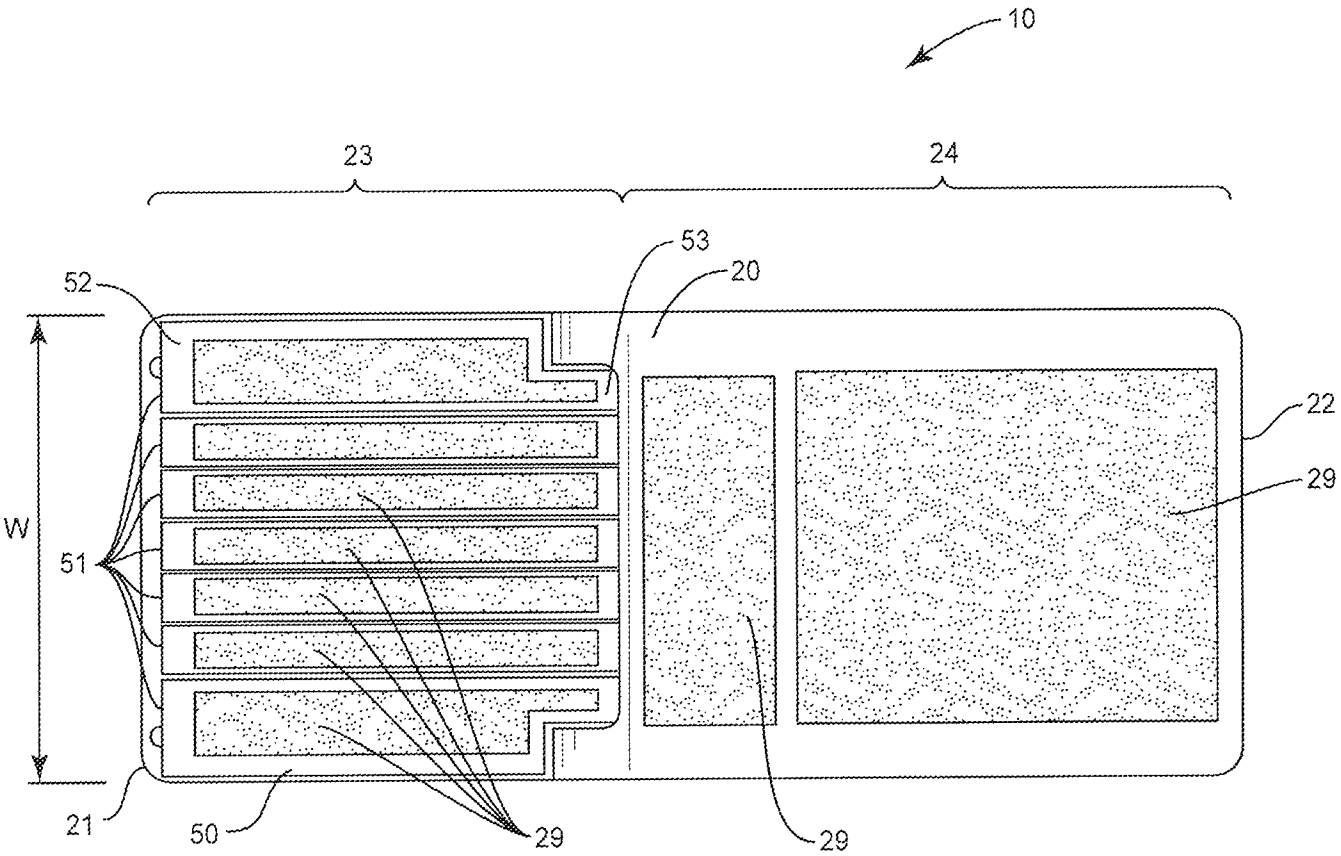
FIG. 3 is a top view of a device with fingers in a first orientation.

FIGS. 1, 2, and 3 each illustrate the device 10 in a first orientation. The device 10 includes a base 20 with a length that extends from a first end 21 and a second end 22. A first section 23 of the base 20 that extends inward from the first end 21 is configured to receive the incline support 50 to support and position the user's toes. A second section 24 of the base 20 is configured to support a remainder of the user's foot. The first section 23 may be recessed below the second section 24 to receive the incline support 50. As illustrated in FIG. 2, the depth of the recess of the first section 23 provides for the top of the incline support 30 to be flush with the second section 24 when the device 10 is in the first orientation. Further, this first orientation with the fingers 51 being in a flat orientation provides for a reduced footprint to facilitate storage and transport of the device 10. The width of the base 20 is roughly equal to the width of the user's foot.

The second section 24 includes a substantially planar face. As illustrated in FIG. 2, the section 24 may include a slight incline with the second end 22 located below other areas of the section 24 that are in closer proximity to the first end 21. The incline provides for positioning the user's heel to be lower than the ball of the foot. This places the ankle in dorsiflexion and loads the Achilles tendon and the muscles in the calf to provide additional stretching. The second section 24 may be formed as a single, integral piece as illustrated in FIG. 2, or may be formed as separate pieces that are placed together, such as an intermediate section that is molded into an opening formed in the base 20.

The base 20 also includes projections 25 that extend along a portion of the recessed first section 23. The projections 25 are spaced apart and are configured to receive a first shaft 30 for attaching the incline support 50 to the base 20. The projections 25 may be positioned on the outer lateral edges of the base 20 with the fingers 51 positioned between the projections 25. The projections 25 may include a height to be flush with the second section 24, and also a top side 54 of the fingers 51 when in a flattened pivotal orientation as illustrated in FIGS. 1, 2, and 3.

One or more feet 92 may extend from the bottom of the base 20. The feet 92 support the device 10 and may be constructed from a material to prevent slipping of the device 10 when used on a smooth surface (e.g., tile floor). In one embodiment, the feet 92 are constructed from rubber that prevents slipping.

Figure 11:
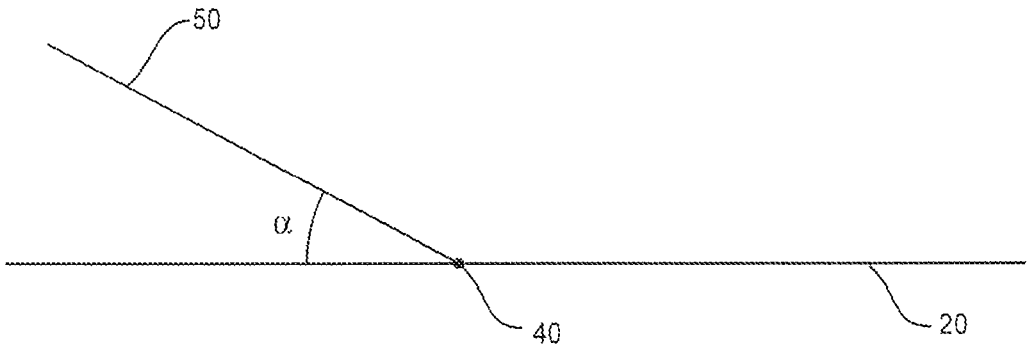
FIG. 11 is a schematic side view illustrating an incline support positioned at an angle relative to a base.

The incline support 50 is pivotally connected to the base 20 and is positioned at the first section 23 of the base 20. The incline support 50 is able to be positioned at a variety of different angular positions relative to the base 20 for stretching the user's foot and lower leg. As schematically illustrated in FIG. 11, the incline support 50 can pivot about an axis 40. The incline support 50 forms an angle $\alpha$ with the base 20. The incline support 50 can be positioned at various angles $\alpha$ depending upon the needs of the user. The range of angles $\alpha$ may vary, with one embodiment including a range of 0° in which the incline support 50 is in a relatively straight orientation (as illustrated in FIGS. 1, 2, and 3), to 90° with the incline support 50 perpendicular to the base 20. As will be discussed below, the incline support 50 may be positioned at various intermediate angles.

The incline support 50 includes a number of separate fingers 51 that are arranged in a row across the base 20. The fingers 51 are each pivotally connected to the base 20 and able to be positioned at different angular orientations from adjacent fingers 51. FIGS. 1 and 3 illustrate the incline support 50 constructed from seven fingers 51. Other embodiments may include various numbers of fingers 51. The fingers 51 include a pair of outer fingers 51 and various numbers of intermediate fingers 51 positioned between the outer fingers 51. Each of the fingers 51 includes an enlarged shape with a first end 52 and a second end 53, and a top side 54 that faces upward and is configured to support the user. Each finger 51 is shaped to be positioned in close proximity and/or abut against the adjacent finger 51.

The top sides 54 of the fingers 51 may include the same or different shapes. The top sides 54 may be flat and include rounded edges. The flat top sides 54 may align in a common plane when the device is in the straight orientation as illustrated in FIGS. 1, 2, and 3.

Figure 4:
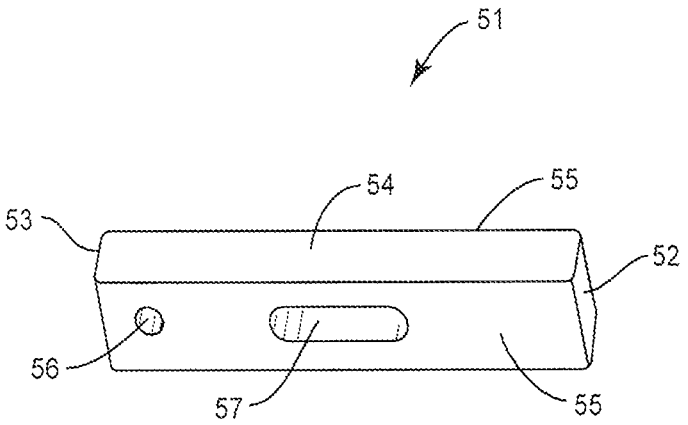
FIG. 4 is a perspective view of an intermediate finger.

Each of the fingers 51 may include the same size and/or shape, or one or more of the fingers 51 may include different shapes and/or sizes. FIGS. 1 and 3 include the outer fingers 51 including a different shape and size than the interior fingers 51. FIG. 4 illustrates an intermediate finger 51 with an elongated shape that extends between the first and second ends 52, 53. The finger 51 also includes the top side 54 that is contacted by the user's foot. The lateral sides 55 are shaped to be in close proximity to and/or in contact with the adjacent fingers 51. FIG. 4 includes flat lateral sides 55 that provide for this positioning. A first opening 56 is positioned in proximity to the second end 53 for receiving a shaft 30 for attaching the fingers 51 to the base 20.

Figure 5:
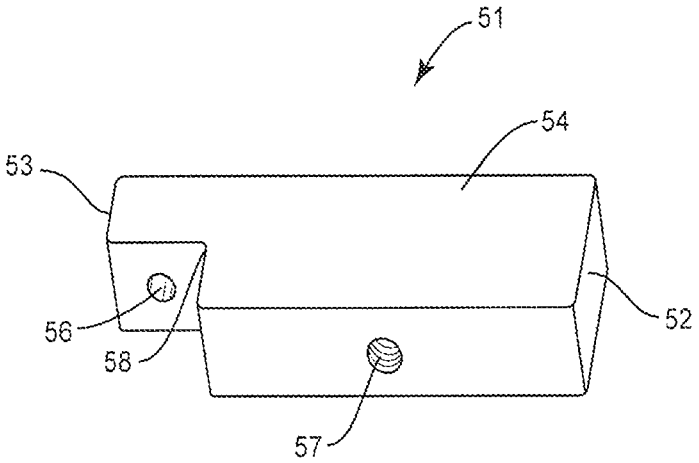
FIG. 5 is a perspective view of an outer finger.

FIG. 5 illustrates an outer finger 51 that includes a corner 58 along an outer lateral side to accommodate the projection 25. The outer finger 51 includes a first opening 56 for receiving the first shaft 30 for attachment to the base 20, and a second opening 57 for receiving the second shaft 31 for adjustably connecting to the other fingers 51.

The shaft 30 forms an axis 40 about which the fingers 51 pivotally move relative to the base 20. The shaft 30 extends through each of the openings 56 in the fingers 51 and at least a portion of the projections 25 to secure the fingers 51 to the base 20. The shaft 30 may include a straight shape with a round cross-sectional shape that matches the shape of the openings 56 in the fingers 51. This provides for each of the fingers 51 to be pivotally attached by the shaft 30 to the base 20. Further, the shape and size of the shaft 30 may match the openings 56 to provide for pivoting movement.

The fingers 51 may pivot about the shaft 30 through a range of angles. An extent of movement in a first direction is limited by contact with the second section 24 of the base 20. In one embodiment, the fingers 51 are in a flat orientation with an underside of each finger 51 contacting against the second section 24. The extent of movement in an opposing second direction may be limited by contact with the back wall 26 of the first section 23. The range of movement may vary, with one embodiment including a range of 90° that extends from the first orientation at 0° as illustrated in FIGS. 1, 2, and 3, to a second orientation at 90° with the fingers 51 in contact with the back wall 26. The fingers 51 may be configured to be adjusted to various angular positioning by one or more supports 60 as will be explained below.

The fingers may each include an enlarged opening 57. For each finger, the opening 57 may be positioned at various positions along the length between the opening 56 that receives the shaft 30 and the second end 52. In one embodiment, the opening 57 is in closer proximity to the second end 53 than to the first end 52. The opening 57 is configured to receive a second shaft 31 that connects the fingers 51 together. In one embodiment, the intermediate opening 57 is smaller in the outer fingers 51 than in the intermediate fingers 51.

The second shaft 31 includes a cross-sectional size that is smaller than the cross-sectional size of the openings 57. This provides for the fingers 51 to be movable to different angular orientations relative to one another. In one embodiment, the second shaft 31 is straight with a circular cross-sectional shape. The shaft 31 is constructed to withstand the weight of the user without bending. The shaft 31 may be constructed from a variety of different materials, including but not limited to steel. In one embodiment, the shaft 31 includes a circular cross-sectional shape with a diameter of 0.25 inches. The cross-sectional size and/or shape of the shaft 31 may be the same or different than that of the shaft 30. In one specific embodiment, shaft 30 is larger than shaft 31.

Figure 6:
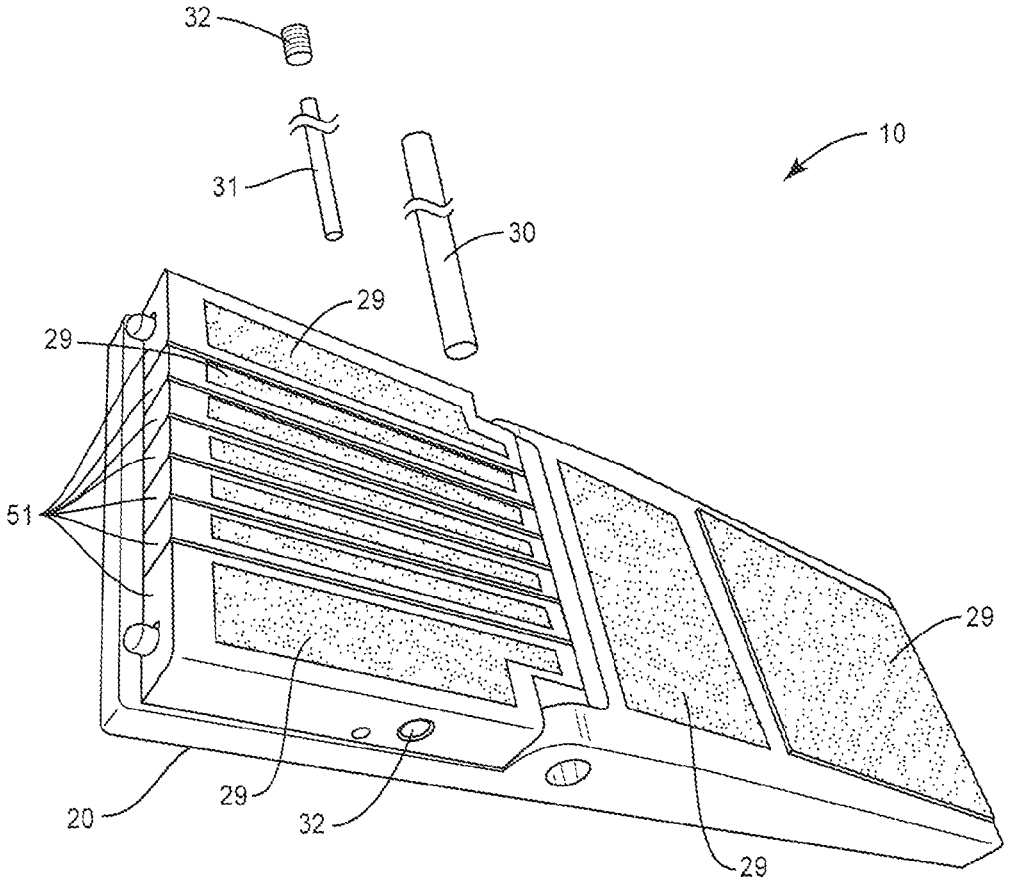
FIG. 6 is a perspective view of a device with first and second shafts removed.

In one embodiment as illustrated in FIG. 6, the second shaft 31 includes a straight shape with a length that extends through each of the interior fingers 51 and a portion of each of the outer fingers 51. The shaft 31 is straight with first and second ends, and a cross-sectional shape that is smaller than the second openings 57. The ends of the shaft 31 are each positioned within the openings 57 in the outer fingers 51. Connectors 32 are secured within the outer sides of the openings 57 to capture the shaft 31. The connectors 32 may be threaded to engage with threads that extend along the openings 57 on the outer fingers 51. With the connectors 32 mounted in the outer fingers 51, the shaft 31 is captured and prevented from escaping from the fingers 51. The shaft 31 is captured in the openings 57 between the connectors 32, but is otherwise not secured to any of the fingers 51. This positioning facilitates movement of the shaft 31 within the openings 57 for the fingers 51 to be movable to the different relative angular orientations.

The fingers 51 may also be connected together in other manners. In one embodiment, an indent is formed in the bottom of the each of the fingers 51 and is sized to receive the shaft 31. In one embodiment, the shaft 31 is connected to the outer fingers 51 and extends across the underside of the intermediate fingers 51.

The shaft 31 is one support member that is used to support the fingers 51 at the various angular orientations. Other support members 31 include but are not limited to a wire and a chain. The various support members 31 are connected to the outer fingers 51 and extend across and support the intermediate fingers 51.

The fingers 51 are configured to be positioned at different angular orientations relative to the base 20. In one embodiment, the range of angles may extend between 0° and 90°. At 0°, the underside of each finger 51 contacts against and is supported by the recessed first section 23 of the base 20.

One or more sections of the base 20 and fingers 51 may include a roughened surface 29 to prevent slipping of the user's foot. The surface 29 may be integrally formed with the base 20 and/or fingers 51 such as through knurling or other surface finishing processes. The surface 29 may also be formed by a separate material such as an adhesive tape with a roughened texture that is attached to the base 20 and/or finger 51.

Figure 7:
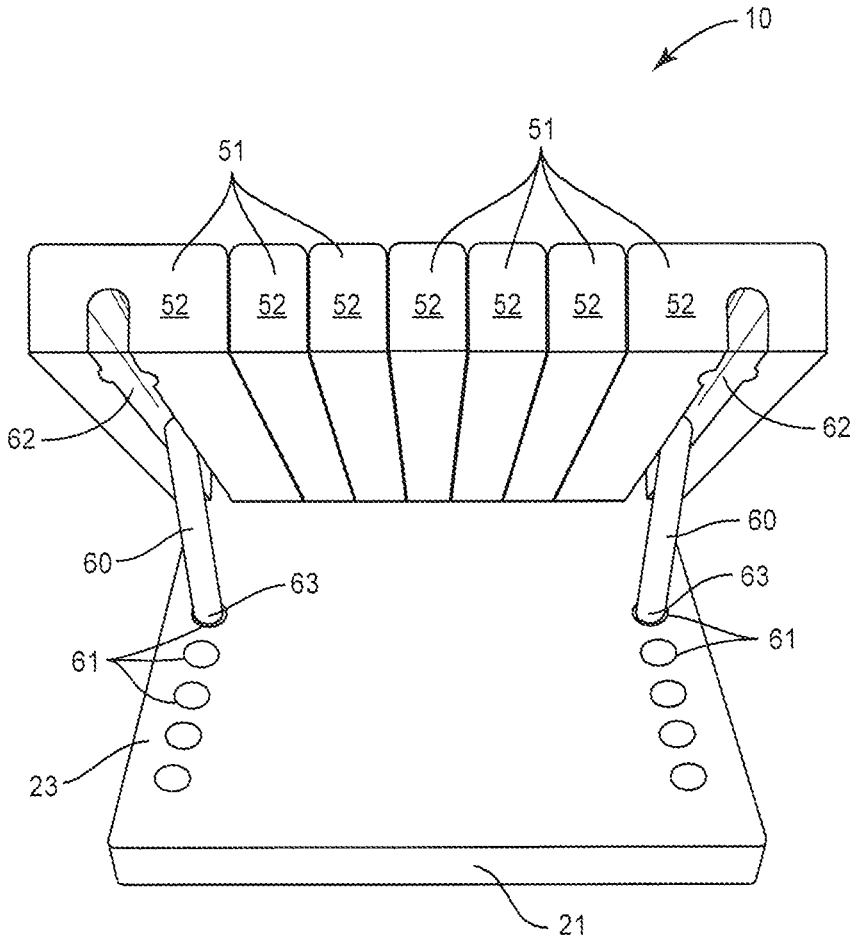
FIG. 7 is a perspective view of a first end of the device with the fingers in a common angular orientation.

As illustrated in FIG. 7, at least one support 60 is configured to support the fingers 51 at the various positive angular positions. In one embodiment, the device 10 includes a single support 60 that supports each of the fingers 51. In another embodiment, each of the outer fingers 51 includes a support 60.

In the embodiment of FIG. 7, the supports 60 are pivotally connected to the fingers 51 with an exposed end 63 configured to fit into an indent 61 formed in the first section 23 of the base 20. The indents 61 are spaced in rows that extend along a portion of the length of the first section 23 to provide for positioning the fingers 51 at different angular positions. Each support 60 is positioned opposite from a row of spaced-apart indents 61. In one embodiment, each of the indents 61 are equally spaced apart such that each successive indent 61 provides for an equal increase in the angle. In one embodiment, each indent 61 is spaced apart to cause a change in the angle of about 8°. Other spacing may be used depending upon the sizing of the device 10 and the needs of the patient. Further, each of the rows of indents 61 may be aligned with one another, or misaligned with one another.

The indents 61 may be positioned to provide support to the fingers 51 at various angular orientations. In one embodiment, the first indent 61 is positioned to support the finger at an angle of about 30°. A last indent 61 is positioned to support the finger at an angle of about 70°. Intermediate indents 61 are positioned for intermediate angles.

The supports 60 may be configured to be positioned in channels 62 on the underside of the fingers 51. The channels 62 include a depth such that the supports 60 are recessed below the underside of the fingers 51. This provides for the fingers 51 to contact against the recessed section 23 of the base 20 when the device 10 is in a flat orientation. The end of each of the supports 60 may extend slightly outward beyond the first end 52 of the finger 51 as illustrated in FIG. 1 to facilitate contact by the user when moving the support 60 between the recessed and open positions.

Figure 8:
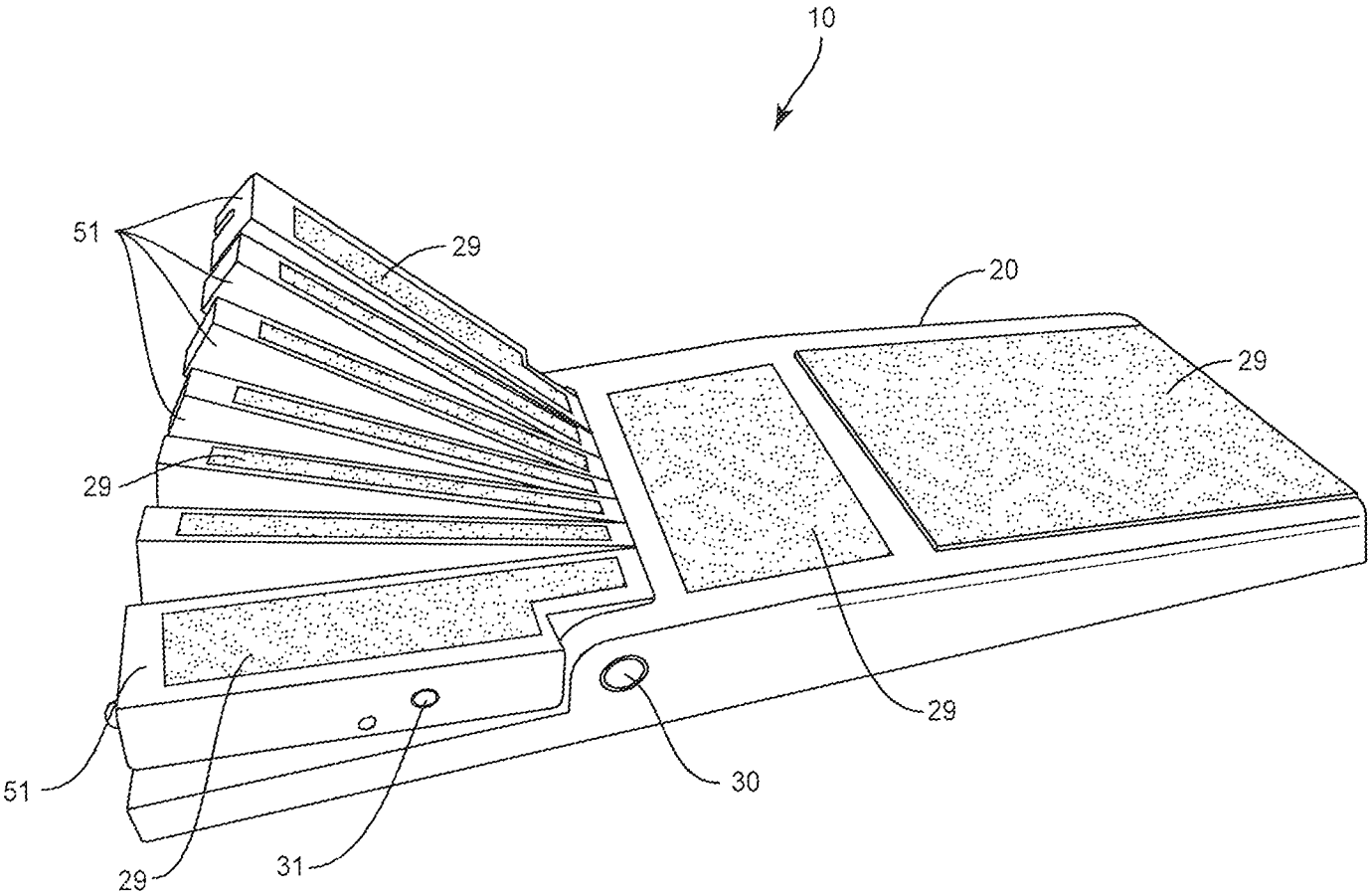
FIG. 8 is a perspective view of a device with the fingers in different angular orientations.
Figure 9:
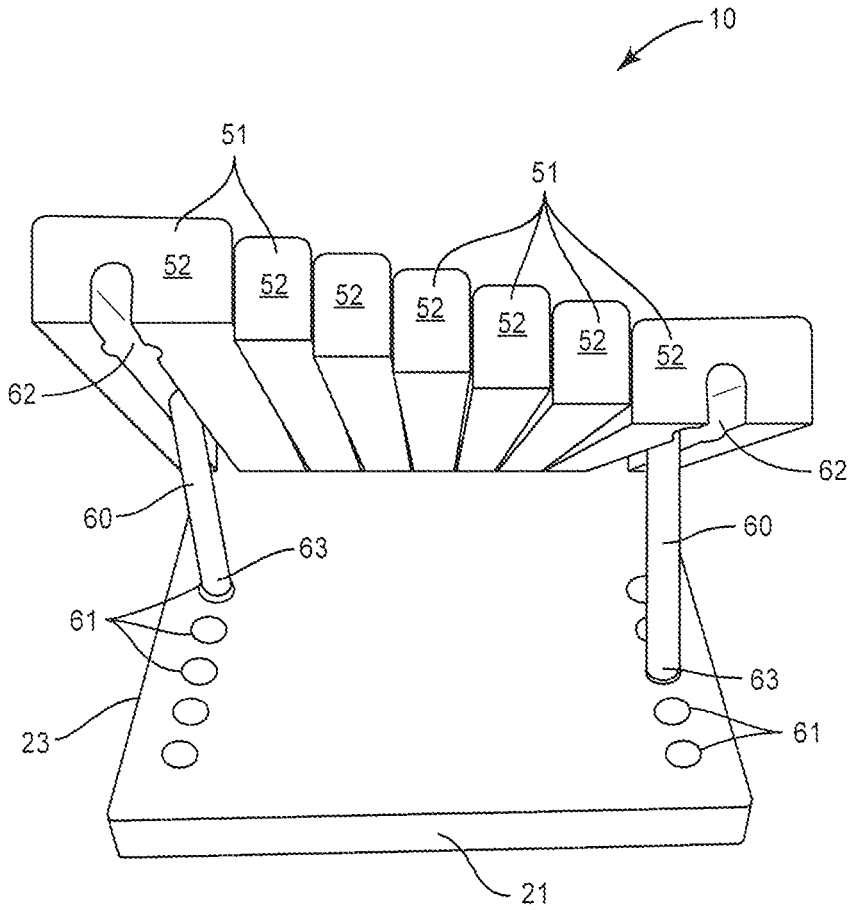
FIG. 9 is a perspective view of a first end of a device with the fingers in different angular orientations.
Figure 10:
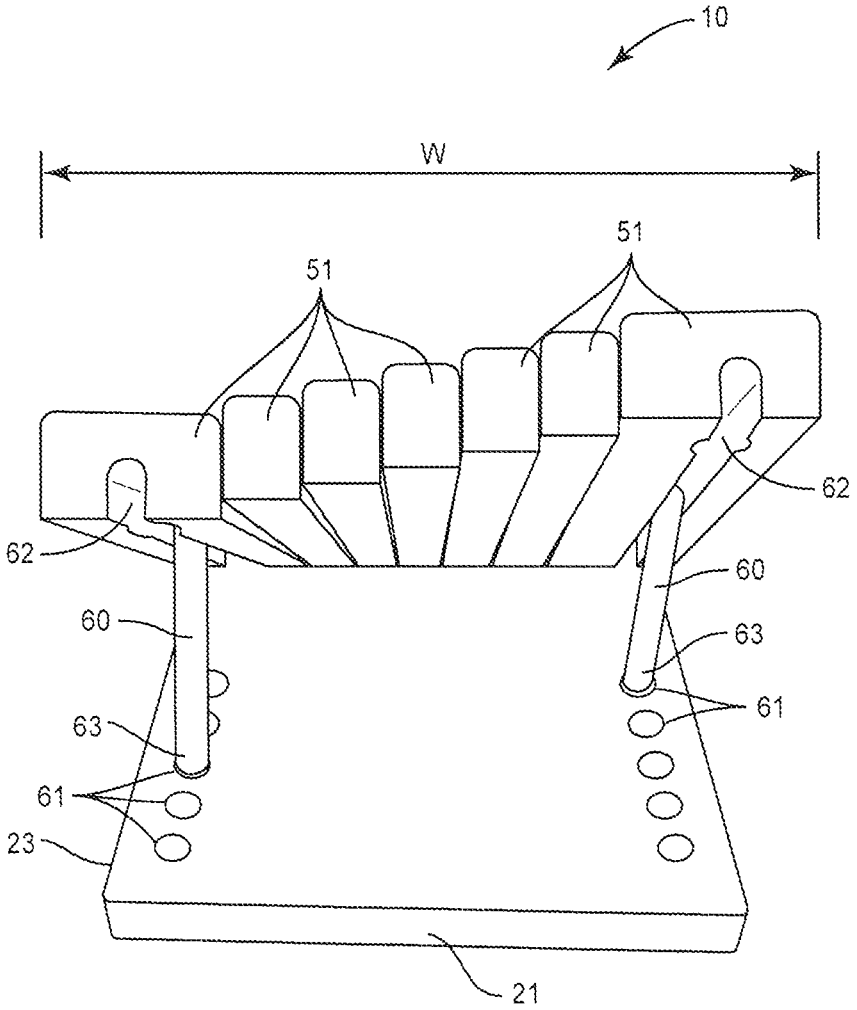
FIG. 10 is a perspective view of a first end of a device with the fingers in a different angular orientation.

As illustrated in FIGS. 8, 9, and 10, the fingers 51 may be positioned at offset orientations with each at a different angular orientation relative to the base 20. The offset orientation includes the fingers 51 aligned at a progressive inclined configuration with the angle varying across the width of the device 10. This may include the outer fingers 51 being supported at different angular orientations and the one or more intermediate fingers 51 positioned at progressive intermediate angles to form the inclined configuration.

The range of angular difference across the width W of the device 10 may vary. In one embodiment, a first outer finger 51 is in an open orientation with the underside contacting against the first section 23 of the base 20 (i.e., $\alpha=0°$), and an opposing second outer finger 51 is positioned at an angle $\alpha$ of about 70°. Each of the intermediate fingers 51 is oriented at a different intermediate angle to span the differences between the two outer fingers 51. In one embodiment with five intermediate fingers 51, each subsequent finger 51 is at an incremental angle of about 14°.

The incremental angle between adjacent fingers 51 is caused by the support member 31 that supports the fingers 51. The support member 31 is connected to each of the outer fingers 51 and spans across and supports the intermediate fingers 51. The support member 31 is positioned at an angle across the width of the device 10 to thus support the intermediate fingers 51 at the different angular orientations.

In one embodiment in which the support member 31 extends through openings 57 in the intermediate fingers 51, the relative sizes between the openings 57 and support member 31 provides for positioning the fingers 51 at the different angular orientations.

In one embodiment as illustrated in FIGS. 9 and 10, the adjacent fingers 51 are positioned at slightly different angular positions. This creates a stair-step configuration between the top sides 54 of the fingers 51. This configuration is adequate for supporting the user's toes at different positions.

The device 10 may be configured for use by either foot (i.e., left foot or right foot). The sizing, positioning, and adjustability provide for the user to place either foot on the device 10 and to perform stretching. Further, the width W of the device 10 is roughly equal to a width of a user's foot.

In use, the user adjusts the fingers 51 to the desired angular orientation. This includes positioning and supporting each of the outer fingers 51 at the desired angular position. Any intermediate fingers 51 will be positioned at a progressive angle between the outer fingers 51 due to the support of the support member 30. The movement of the intermediate fingers 51 occurs at the same time as the positioning of either of the outer fingers 51 due to the connection of the support member 30.

In one embodiment, the user may start with each of the fingers 51 positioned at the same angular position. This includes the user setting the angle of the two outer fingers 51 at the same angular position. The support member 30 is positioned and configured to also support any intermediate fingers 51 at that same angular position.

Once the device 10 is set, the user places their foot on the device 10 with their toes positioned on the fingers 51 and a remainder of the foot placed on the second section 24 of the base 20. The angle of the fingers 51 relative to the second section 24 places the toes in dorsi-flexion (i.e., hyperextension). Simultaneously, the ankle is also positioned in dorsiflexion due to the angled shape of the base 20 with the heel of their foot being positioned lower than the ball of their foot. This positioning provides for simultaneous stretching of the muscles of the lower leg and foot. The placement of the supports 60 in the indents 61 in the base 20 and the strength of the shaft 31 that extends through and connects the fingers 51 provides for the fingers 51 to form a secure structure that does not deform upon the application of the user standing on the device 10. This provides for the user to place a great amount of weight on their foot to provide for weight-bearing stretching. In one embodiment, the user may place the device 10 in proximity to a wall or other support structure that they can hold while stretching. The user is then able to lean directly over the device 10 to provide additional stretching of the foot and the lower leg by simultaneously dorsiflexing the toes and ankle.

The fingers 50 may be set at the desired angular orientation to provide the desired amount of stretching. A beginning user may initially start at a smaller angle and progress to greater angles. Further, a user that stretches often may begin their stretching exercises with a relatively small angle for a first amount of stretching. Once complete, the user re-adjusts the fingers 51 to increase the finger angle to provide for additional stretching.

The user is also able to adjust the relative angular positions of the fingers 51 across the width W of the device 10 to provide for lateral twisting and stretching of the foot in one or more additional planes. This occurs when the fingers 51 are placed at different angular positions relative to one another.

The user positions and supports a first outer finger 51 at a first angular position and an opposing second outer finger 51 at a different angular setting. The support for each finger 51 may be provided by placing the exposed end 62 of the support member 60 of each finger 51 in the corresponding indent 61 in the base 20. The positioning of outer fingers 51 causes any intermediate fingers 51 to be positioned at progressive intermediate angles. The extent of angular difference across the width W will depend upon the needs of the user. Once positioned and supported, the user is then able to apply their weight to their foot to perform stretching. Thus, the user is able to simultaneously have both dorsi-flexion and lateral stretching of their foot, toes, arch, and lower leg.

The user is able to have a variety of different angular positions across the width W of the device 10. Initially, the angular difference between the sides of the device 10 may be relatively small (e.g., 30° difference between the sides). The user may then move to greater angles as the user warms-up and/or becomes more flexible after continued use.

Once the stretching is completed for a first foot, the device 10 can be adjusted for stretching the other foot. The structure of the device 10 accommodates both left and right feet in a similar manner.

The width W of the device 10 is roughly equal to a width of the user's foot. In use, the user may position their first toe (i.e., big toe) on a first outer finger 51 and their fifth toe (i.e., small toe) on an opposing second outer finger 51. The intermediate toes of the user are supported by either the outer fingers 51 and/or any intermediate fingers 51. The progressive angle of the fingers 51 across the width W of the device provides for lateral twisting of the foot.

Once the stretching exercises are complete, the user can pivot the supports 60 into the corresponding channels 62 in the respective fingers 51. The fingers 51 can then be placed in a relatively flat orientation (e.g., FIG. 1, 2, 3) and in contact with the first section 23 of the base 20. This flat orientation reduces the overall size of the device 10 and facilitates storing and/or handling the device 10.

The device 10 may include a pair of outer fingers 51 and one or more intermediate fingers 51. The device 10 may also include just a pair of outer fingers 51 without any intermediate fingers 51.

The device 10 may be constructed from a variety of different materials. In one embodiment, the base 20 and fingers 51 are constructed from plastic, and the support members 30, 31 and support arms 60 are each constructed from steel. The roughed surface 29 is formed by a rubber tape that is attached by adhesive to the one or more surfaces.

The device 10 is configured for stretching a variety of different portions of the foot and lower leg of the user. One specific application of the device 10 is for the treatment of plantar fasciitis. A variety of other injuries of the foot and lower leg may also be treated using the device 10 as described above.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A device for stretching portions of a foot and lower leg, the device comprising:

a base having a rear section with a back end and a front section with a front end;

a plurality of fingers hingedly connected in an overlapping arrangement with the base, each of the fingers comprising an elongated shape with a length measured between a pivot end and a free end, the fingers comprising first and second fingers that are spaced apart across a width of the base and at least one intermediate finger positioned between the first and second fingers;

a support member with an elongated shape and opposing first and second ends, the support member extending transversely across the fingers with the first end at the first finger and the second end at the second finger and connecting together the first and second fingers, the support member positioned along the fingers away from the pivot ends;

the fingers being pivotally connected to the base and movable between a common angular orientation in which each of the fingers is at a common angle relative to the base, and an offset angular orientation in which the first finger is at a first angle relative to the base and each of the one or more intermediate fingers and the second finger are at progressively different angles relative to the base with the fingers positioned in a inclined configuration across the width of the base;

the support member extending across and supporting the at least one intermediate finger in each of the common angular orientation and the offset angular orientation.

2. The device of claim 1, wherein the support member comprises a rigid shaft with opposing first and second ends, the first end being positioned at the first finger and the second end positioned at the second finger.

3. The device of claim 1, wherein each of the fingers is pivotally connected to the base about a common axis.

4. The device of claim 3, wherein the common axis is formed by a shaft that extends through the pivot end of each of the fingers.

5. The device of claim 1, wherein the support member extends through an opening formed within each of the at least one intermediate finger.

6. The device of claim 1, wherein the fingers are aligned in a row and the first finger is an outer lateral finger on a first lateral side of the row and the second finger is another outer lateral finger on a second lateral side of the row.

7. The device of claim 1, further comprising a first support arm extending from an underside of the first finger and a second support arm extending from an underside of the second finger, each of the support arms including an exposed end that engages with the base to support the fingers.

8. The device of claim 7, further comprising first and second rows of indents formed in the base, each of the rows comprise a plurality of indents that are spaced apart and extend away from a front end of the base, each of the indents sized to receive the exposed end of one of the first and second support arms.

9. The device of claim 1, wherein the fingers extend across an entirety of the width of the base.

10. The device of claim 1, wherein the front section of the base is recessed below the back section of the base such that a top side of the fingers aligns with the back section when the device is in an open orientation.

11. A device for stretching portions of a foot and lower leg, the device comprising:

a base having a first section and a second section;

an incline support positioned at the first section of the base and being pivotally connected to the base at a pivot axis, the incline support being movable about the pivot axis within a range of angular positions between a first angular position and a larger second angular position, the incline support being configured to be supported at the various angular positions relative to the base;

a support member connected to the incline support, the support member comprising an elongated shape with opposing first and second ends, the support member extending across the incline support and being spaced away from the pivot axis;

the incline support being divided into a plurality of separate fingers that each include a first end connected to the base at the pivot axis and a free second end;

each of the fingers being positionable relative to the base at different angles ranging from the first and second angular positions with a difference in the angles between adjacent ones of the fingers being limited by the support member.

12. The device of claim 11, further comprising first and second support arms that are pivotally connected to one of the base and the incline support, the first and second support arms comprising an exposed end configured to engage with the other of the base and the incline support to position the incline support relative to the base.

13. The device of claim 11, wherein the incline support extends across an entirety of the width of the front section.

14. The device of claim 11, wherein each of the fingers includes an opening and the support member is positioned in the opening.

15. The device of claim 11, wherein the first section of the base is recessed below the second section of the base and the incline support is positioned in an overlapping orientation with the first section of the base such that a top side of the incline support aligns with the second section in an open orientation.

* * * * *